US005923934A

United States Patent [19]

Hattori

[11] Patent Number: 5,923,934

[45] Date of Patent: Jul. 13, 1999

[54] DEVELOPING DEVICE HAVING TONER SUPPLYING ROLL WITH FLUORORESIN PARTICLES DISPERSED THEREIN

[75] Inventor: Tomoaki Hattori, Nagoya, Japan

[73] Assignee: Brother Kogyo Kabushiki Kaisha, Nagoya, Japan

[21] Appl. No.: 09/115,770

[22] Filed: Jul. 15, 1998

[30] Foreign Application Priority Data

Jul. 17, 1997 [JP] Japan ..... 9-192591

[51] Int. Cl.[6] ..... G03G 15/08

[52] U.S. Cl. ..... 399/281; 399/265; 399/286

[58] Field of Search ..... 399/222, 223, 399/258, 265, 269, 279, 281, 272, 286

[56] References Cited

U.S. PATENT DOCUMENTS

| | | | |
|---|---|---|---|
| 4,788,570 | 11/1988 | Ogata et al. | 399/281 X |
| 4,841,331 | 6/1989 | Nakayama et al. | 399/281 |
| 5,132,734 | 7/1992 | Momiyama et al. | 399/281 |
| 5,179,414 | 1/1993 | Bhagat | 399/258 |
| 5,245,391 | 9/1993 | Suzuki et al. | 399/286 X |
| 5,287,150 | 2/1994 | Kinoshita et al. | 399/281 |
| 5,311,264 | 5/1994 | Kinoshita | 399/281 |
| 5,594,198 | 1/1997 | Ikeda et al. | 399/281 |
| 5,628,043 | 5/1997 | Ikeda et al. | 399/281 |
| 5,768,668 | 6/1998 | Shiraki et al. | 399/281 |

*Primary Examiner*—S. Lee
*Attorney, Agent, or Firm*—Oliff & Berridge, PLC

[57] ABSTRACT

In a developing device for an image forming device, such as a laser printer, a supply roller is in rolling contact with and supplies toner particles to a developing roller which in turn is in rolling contact with a photosensitive drum and supplies toner particles to an electrostatic latent image formed thereon. The developing roller and the supply roller press against each other with a slight pressure. The supply roller has a resilient outer form layer formed from a silicone foam or urethane foam and fluororesin particles are dispersed within the foam. With the dispersion of the fluororesin particles throughout the resilient outer form layer of the supply roller, toner particles can be better charged by contact between the resilient outer foam layers of the supply roller and the developing roller. As a result, improper image development is less likely to occur and the developing roller will not scratched or otherwise damaged.

17 Claims, 2 Drawing Sheets

DEVELOPING DEVICE HAVING TONER SUPPLYING ROLL WITH FLUORORESIN PARTICLES DISPERSED THEREIN

BACKGROUND OF THE INVENTION

1. Field of the Invention

The present invention relates to a developing device for an image forming device, such as a copy machine, a laser printer, or a facsimile machine. More particularly, the invention relates to a toner supply roller for supplying toner particles to a developing roller which in turn supplies the toner particles to a photosensitive drum.

2. Description of the Related Art

A developing device provided in an image forming device, such as a copy machine, a laser printer, or a facsimile machine, includes: a photosensitive drum on which an electrostatic latent image is formed; a developing roller for bearing toner particles thereupon and supplying toner particles to the photosensitive drum; and a supply roller for supplying toner particles to the developing roller. The developing roller is disposed in contact with the photosensitive drum. The supply roller is formed from a foam material and is disposed in contact with the developing roller so that the foam material is compressed by a certain amount.

To perform printing, a charge unit uniformly charges the surface of the photosensitive drum. A laser generating unit then irradiates the charged surface of the photosensitive drum by scanning a laser beam across the surface of the photosensitive drum. The laser beam forms an electrostatic latent image on the surface of the photosensitive drum based on image data.

The supply roller is rotated to transport toner particles from a toner box to the developing roller. The toner particles are charged by rubbing contact with the supply roller and the developing roller where the two rollers contact each other.

Toner particles supplied onto the developing roller are regulated into a thin film on the surface of the developing roller by a blade, for example, disposed at the side of the developing roller. The developing roller is applied with a bias voltage having a fixed voltage value so that toner borne on the developing roller travels from the developing roller toward the electrostatic latent image formed on the photosensitive drum.

Therefore, when rotation of the developing roller brings the charged toner particles borne on the developing roller into contact with the photosensitive drum, the charged toner particles cling to the electrostatic latent image formed on the surface of the photosensitive drum so that the electrostatic latent image is developed by the toner particles into a visible toner image. Afterward, toner particles clinging to the surface of the photosensitive drum are transferred onto a sheet, thereby completing the printing process.

In order for this type of developing device to properly develop an electrostatic latent image using toner particles, the toner particles must be sufficiently charged. When insufficiently charged toner particles on the developing roller are used to develop the electrostatic latent image, the insufficiently charged toner particles can cling to areas of the photosensitive drum other than areas formed with the electrostatic latent image, so that the resultant toner image will be different from the desired image.

To insure that the toner particles supported on the developing roller are sufficiently charged, the toner particles must be brought into sufficient contact with the supply roller and the developing roller where the supply roller and the developing roller contact each other, so that the toner particles can be sufficiently charged by friction between the supply roller and the developing roller. This requires that the supply roller be strongly pressed against the developing roller. However, if the supply roller presses too strongly against the developing roller, the developing roller can be damaged so that lines and streaks, and other signs of poor image development, can appear in the developed image.

SUMMARY OF THE INVENTION

It is an object of the present invention to overcome the above-described problems and to provide a developing device including a toner supplying body capable of sufficiently charging toner without the supply roller strongly pressing against the developing roller.

A developing device according to the present invention includes a toner bearing body for supplying toner particles to an electrostatic latent image bearing body, on which is formed an electrostatic latent image, and a toner supplying body for supplying toner particles to the toner bearing body. The toner supplying body includes a resilient layer rotating against the toner bearing body. Fluororesin particles are dispersed throughout the resilient layer.

Because the fluororesin particles are dispersed throughout the resilient layer, toner particles are better charged by contact between the toner bearing body and the toner supplying body. For this reason, the toner particles can be properly charged without strongly pressing the toner supplying body against the toner bearing body. As a result, the amount of sufficiently charged toner particles can be increased and proper development using toner particles can be more reliably performed.

Because the toner supplying body need not be strongly pressed against the toner bearing body, the toner bearing body will be less subject to scratches and other damage so that defective development, such as lines, caused by damage on the toner bearing body will be less likely to occur.

Further, because the fluororesin particles are dispersed throughout the resilient layer, fluororesin particles will always exist on the surface of the resilient layer even if the surface of the resilient layer is subjected to friction over long periods of time. In contrast, if the fluororesin particles were merely coated on the surface of resilient layer, long periods of friction would wear the fluororesin particles off. By dispersing the fluororesin particles throughout the resilient layer, durability of the resilient layer can be increased.

The resilient layer can be formed from an urethane foam or a silicone foam. When the resilient layer is formed from an urethane foam or a silicone foam, the resilient layer has great resistant to friction and heat. Therefore, the resilient layer is not only capable of properly charging toner particles, but is also has excellent friction resistance and heat resistance properties.

It is desirable that the fluororesin particles have a diameter of 10 $\mu$m or less. If the diameter of the fluororesin particles exceeds 10 $\mu$m, separation of the fluororesin particles from the resilient roller is likely to occur. If this occurs, fluorine component contained in the surface of the resilient roller will be reduced with the result that the toner particles cannot be properly charged. On the other hand, if the diameter of the fluororesin particles is set to 10 $\mu$m or less, good dispersion of the fluororesin particles into the resilient roller can be attained. As a result, the toner particles will have an increased chance to contact the fluororesin particles and thus the toner particles can be properly charged.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

A laser printer 1 according to a preferred embodiment of the present invention will be described while referring to the accompanying drawings. In the following description, the expressions "upper", "lower", "above", "below", "front" and "rear" are used to define the various parts when the printer is disposed in an orientation in which it is intended to be used.

Figure 1:
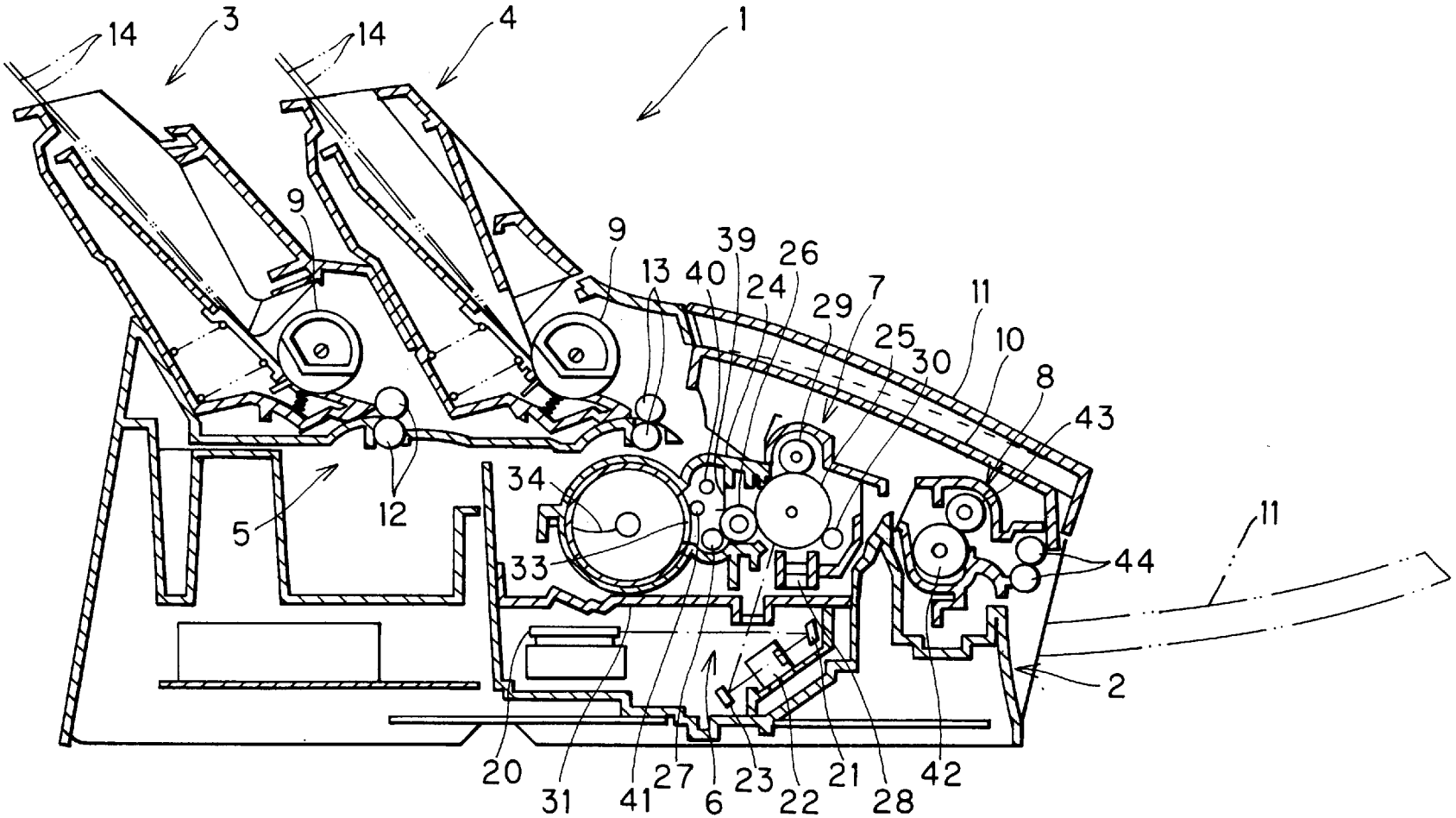
FIG. 1 is a cross-sectional view showing a laser printer including a developing device according to the present invention.

The laser printer 1 of FIG. 1 includes a developing device according to the present invention. The laser printer 1 further includes a case 2; a first and second sheet feed trays 3, 4 provided to the upper rear of the case 2; a sheet transport mechanism 5 provided in the case 2; and a print station capable of printing on sheets. The print station includes a scanner unit 6; a process unit 7; and a fixing unit 8, all of which are housed in the case 2.

A top cover 10 is disposed above the print station at the front upper portion of the case 2 and enables the case 2 to be opened to allow access to the components inside. A discharge tray 11 is disposed at the front surface of the case 2 and can be opened and closed between an opened position and a closed position. The discharge tray 11 is provided for receiving printed sheets when in its opened position.

The first and second sheet feed trays 3, 4 are freely detachably attached to the case 2 and can be stacked thereon with a stack of sheets 14. A pick-up roller 9 for feeding out one sheet at a time of the stacked sheets 14 is provided to the lower edge of each of the first and second sheet feed trays 3, 4.

The sheet transport mechanism 5 is for transporting sheets 14 selectively fed from the first and second sheet feed trays 3, 4 toward the process unit 7. The sheet transport mechanism 5 includes a pair of feed rollers 12 provided to the lower edge of the first sheet feed tray 3 and a pair of registration rollers 13 provided to the lower edge of the second sheet feed tray 4.

Rotation of the pick-up roller 9 corresponding to the first sheet feed tray 3 supplies a sheet 14 from the first sheet feed tray 3 to the pair of feed rollers 12. Rotation of the pair of feed rollers 12 supplies the sheet to the pair of registration rollers 13. The pair of registration rollers 13 perform a registration operation on the transported sheet 14 to align the front edge of the sheet 14. After the registration operation is performed, the sheet 14 is transported to the process unit 7 by drive of the registration rollers 13.

Similarly, rotation of the pick-up roller 9 corresponding to the second sheet feed tray 4 supplies a sheet 14 to the registration rollers 13, which perform the registration operation on the sheet 14. Afterward, rotation of the registration rollers 13 transports the sheet 14 to the process unit 7.

The scanner unit 6 is disposed below the process unit 7 and includes a laser emitting portion (not shown), a polygon mirror 20, reflecting mirrors 21, 23, and a lens 22. The laser emitting portion emits a laser beam based on image data. As shown by a chain line in FIG. 1, the laser beam reflects off the polygon mirror 20 and the reflecting mirror 21, passes through the lens 22, and reflects off the reflecting mirror 23 in this order. Then, the laser beam scans the surface of the photosensitive drum of the process unit 7 to be described later.

Figure 2:
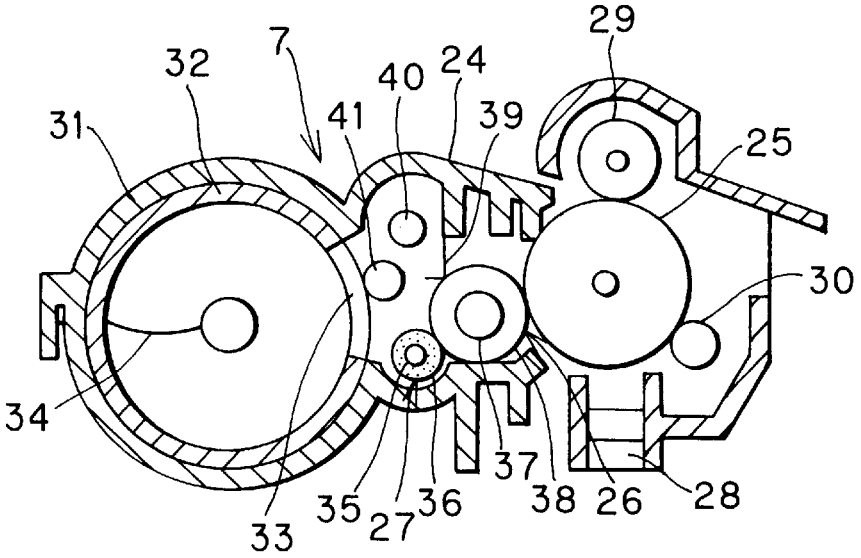
FIG. 2 is an enlarged cross-sectional view showing a process unit of the laser printer of FIG. 1.

FIG. 2 is an enlarged cross-section of the process unit 7. Next, an explanation will be provided for the process unit 7 while referring to FIG. 2. As shown in FIG. 2, the process unit 7 includes a casing 24 housing a photosensitive drum 25, a developing roller 26, a supply roller 27, a scorotoron type charge unit 28, a transfer roller 29, a cleaning roller 30, and a toner box 31. The process unit 7 has a cartridge-like configuration that can be attached in and detached from a predetermined region within the case 2.

The toner box 31 includes a removable toner cartridge 32. To replenish the supply of toner particles in the process unit 7, the process unit 7 is detached from the case 2 and the toner cartridge 32 is removed and replaced with a new one. An agitating member 34 is disposed in the toner cartridge 32 for agitating the toner particles in the cartridge 32 and dispensing the toner particles through a toner supply port 33 opened on the side of the toner box 31. Toner particles used in the present invention are non-magnetic and made from a single component.

Figure 3:
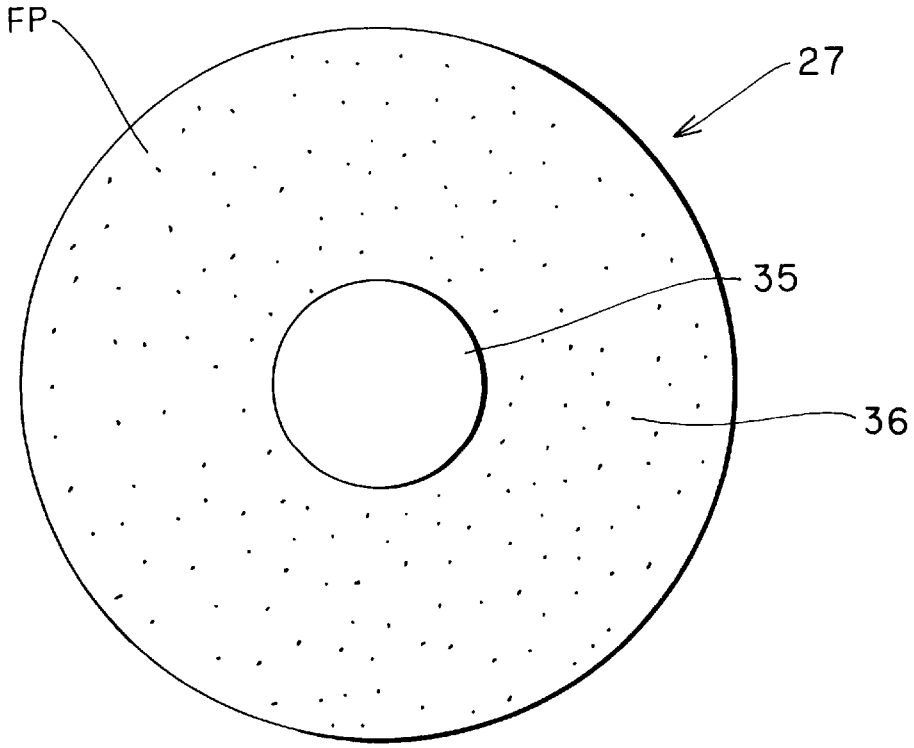
FIG. 3 is an enlarged cross-sectional view showing a supply roller.

The supply roller 27 is rotatably disposed to the side of the toner supply port 33. As is best shown in FIG. 3, the supply roller 27 includes: a metal roller shaft 35 formed from a steel; and a resilient outer foam layer 36 covering the outer periphery of the roller shaft 35. The resilient outer foam layer 36 is formed from an electroconductive foam to be described later. Two auger members 40, 41 are rotatably disposed near the toner supply port 33 of the toner box 31. The auger members 40, 41 are for uniformly dispersing the toner particles dispensed from the toner supply port 33 uniformly within the casing 24.

The developing roller 26 is rotatably disposed adjacent to the supply roller 27 so that the developing roller 26 and the supply roller 27 press against each other with a slight pressure. The developing roller 26 includes a metal roller shaft 37 formed from a steel and a resilient outer foam layer 38 covering the outer periphery of the roller shaft 37. The resilient outer foam layer 38 is formed from a hard electroconductive rubber or from the same electroconductive foam as the resilient outer foam layer 36. Because the developing roller 26 and the supply roller 27 press against each other with a slight pressure, the resilient outer foam layer 36 of the supply roller 27 abuts against the resilient outer foam layer 38 of the developing roller 26 in a slightly compressed condition. It should be noted that the roller shaft 35 and the roller shaft 37 can be formed from any type of steel.

The photosensitive drum 25 is rotatably disposed to the side of and in confrontation with the developing roller 26 so as to contact the developing roller 26. As the photosensitive drum 25 is rotated, the scorotoron charge unit 28 uniformly charges the surface of the photosensitive drum 25. Then, the scanner unit 6 exposes the photosensitive drum 25 with a rapidly scanning laser beam based on the image data, thereby forming an electrostatic latent image on the photosensitive drum 28. Further rotation of the photosensitive drum 28 brings the electrostatic latent image to the position where the surface of the photosensitive drum 25 contacts the developing roller 26.

The supply roller 27 is rotated to supply toner particles from the toner supply port 33 to the photosensitive drum 25 through the developing roller 26. A blade 39 is disposed above the developing roller 26 so as to contact the side of the developing roller 26. The blade 39 regulates thickness of the toner particles on the resilient outer foam layer 38 of the developing roller 26 into a layer with a fixed thickness. The toner particles on the developing roller 26 are charged by friction generated at the contact position between the resilient outer foam layers 36, 38.

A power source (not shown) is provided for supplying a constant d.c. voltage to the shaft 37 of the developing roller 26. The power source applies a constant bias voltage to the shaft 37 that induces the toner particles on the developing roller 26 to travel from the resilient outer foam layer 38 toward the electrostatic latent image on the surface of the photosensitive drum 25. As a result, when rotation of the developing roller 26 brings toner particles supported on the resilient outer foam layer 38 of the developing roller 26 into contact with the photosensitive drum 25, the toner particles cling to the electrostatic latent image formed on the surface of the photosensitive drum 25 so that the electrostatic latent image is developed into a visible toner image.

The transfer roller 29 is disposed in opposition with the photosensitive drum 25 at the side of the photosensitive drum 25. Toner particles clinging to the electrostatic latent image, that is, the toner image, are transferred to a sheet 14 passing between the photosensitive drum 25 and the transfer roller 29. The sheet 14 with the toner image formed thereon is transported to the fixing unit 8 where the toner image is fixed onto the sheet 14.

Toner particles remaining on the photosensitive drum 25 are collected temporarily by the cleaning roller 30 and then returned to the surface of the photosensitive drum 25, from where toner particles are collected at a predetermined timing by the developing roller 26.

As shown in FIG. 1, the fixing unit 8, which is for thermally fixing toner particles transferred onto the sheet 14, includes a heating roller 42, a pressing roller 43 pressed against the heating roller 42, and a pair of discharge rollers 44. The pair of discharge rollers 44 are disposed downstream from rollers 42, 43, and are for discharging sheets 14 from the case 2. After a toner image transferred onto the sheet 14 is fixed by the heating roller 42 and the pressing roller 43, the sheet is discharged by the discharge rollers 44 onto the discharge tray 11.

Next, the resilient outer foam layer 36 according to the present embodiment will be described in more detail. The resilient outer foam layer 36 is formed from a silicone foam or urethane foam. Moreover, fluororesin particles are dispersed within the foam.

The silicone or urethane foam can be produced using conventional foam forming processes performed on particular materials well known in the art. The fluororesin particles can be dispersed within the foam by mixing or otherwise compounding fluororesin particles in the silicone or urethane base materials while subjecting the silicone or urethane base materials to foam forming processes. By dispersing fluororesin particles in the foam, the fluororesin particles will not be removed from the surface of the foam by long periods of friction as would happen if any materials were coated on the surface of the foam. In this way, the foam dispersed with the fluororesin particles is highly durable.

Examples of fluororesin materials suitable for use as the fluororesin particles of the present invention include polyvinylidene fluoride, polytetrafluoroethylene, perfluoro alkoxide, and fluorosurfactants. Of these materials, polytetrafluoroethylene is the most desirable. Further, it is desirable that the fluororesin particles have a diameter equal to or less than 10 $\mu$m. When the diameter of the fluororesin particles exceeds 10 $\mu$m, separation of the fluororesin particles from the resilient outer foam layer 36 is likely to occur. If this occurs, the toner particles cannot be properly charged with the aid of the fluroresin particles. For this reason, the fluororesin particles according to the present invention have a diameter equal to or less than 10 $\mu$m.

Because the fluororesin particles are dispersed throughout the resilient outer foam layer 36 of the supply roller 27, the toner particles can be better charged by contact between the resilient outer foam layers 36, 38. Therefore, toner particles on the resilient outer foam layer 38 of the developing roller 26 can be properly charged without the supply roller 27 strongly pressing against the developing roller 26. As a result, there will be less improperly charged toner particles so that improper image development is less likely to occur. Further, because the supply roller 27 need not be strongly pressed against the developing roller 26, the developing roller 26 will not scratched or otherwise damaged. Therefore, lines or other types of improper image development caused by such damage will not occur. Accordingly, the developing roller 26 with this configuration enables superior image development and contributes to achieving a more durable and superior process unit 7.

When the resilient outer foam layer 36 of the supply roller 27 is formed from a silicon or urethane foam, the resilient outer foam layer 36 will have great resistance to friction and heat. Therefore, by forming the resilient outer foam layer 36 from a silicon or urethane foam, the outer foam layer 36 will have high resistance to friction and heat as well as being capable of properly charging toner particles. As a result, defective developing is unlikely to occur and the process unit 7 can have excellent durability.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A developing device comprising:

a toner bearing body bearing toner particles thereon;

an electrostatic latent image bearing body formed thereon with an electrostatic latent image, said toner bearing body supplying the toner particles to the electrostatic latent image bearing body;

a toner supply body including a resilient outer layer in confrontation with said toner bearing body, wherein fluororesin particles are dispersed throughout the resilient outer layer.

2. The developing device according to claim 1, wherein the resilient outer layer is formed from silicon foam.

3. The developing device according to claim 1, wherein the resilient outer layer is formed from urethane foam.

4. The developing device according to claim 1, wherein each of the fluororesin particles has a diameter of 10 $\mu$m or less.

5. A toner supplying device for supplying toner particles to a toner bearing body that supplies toner particles to an electrostatic latent image bearing body formed thereon with an electrostatic latent image, the toner supplying device comprising:

a shaft;

a resilient outer layer covering said shaft and rotating in confrontation with the toner bearing body, wherein fluororesin particles are dispersed throughout the resilient outer layer.

6. The toner supplying device according to claim 5, wherein the resilient outer layer is formed from silicon foam.

7. The toner supplying device according to claim 5, wherein the resilient outer layer is formed from urethane foam.

8. The toner supplying device according to claim 5, wherein each of the fluororesin particles has a diameter of 10 $\mu$m or less.

9. A developing device comprising:

a supply roller having a roller shaft and a resilient outer foam layer covering the roller shaft;

a developing roller rotatably disposed adjacent to said supply roller so that said developing roller and said supply roller press against each other, said developing roller having a roller shaft and a resilient outer foam layer covering the roller shaft; and a photosensitive drum rotatably disposed adjacent to said developing roller so that said developing roller and said photosensitive drum are in contact with each other and said developing roller supplies toner particles to said photosensitive drum, wherein fluororesin particles are dispersed throughout the resilient outer foam layer of said supply roller.

10. The developing device according to claim 9, wherein the resilient outer foam layer of said supply roller is formed from an electroconductive foam.

11. The developing device according to claim 9, wherein the resilient outer foam layer of said developing roller is formed from a hard electroconductive rubber.

12. The developing device according to claim 9, wherein the resilient outer foam layer of said developing roller is formed from an electroconductive foam.

13. The developing device according to claim 9, further comprising a power source that supplies a bias voltage to the shaft of said developing roller to thereby induce the toner particles on said developing roller to travel from the resilient outer foam layer of said developing roller toward an electrostatic latent image formed on said photosensitive drum.

14. The developing device according to claim 9, wherein the fluororesin particles are made from polytetrafluoroethylene.

15. The developing device according to claim 9, wherein the fluororesin particles are made from polyvinylidene fluoride.

16. The developing device according to claim 9, wherein the fluororesin particles are made from perfluoro alkoxide.

17. The developing device according to claim 9, wherein the fluororesin particles are made from fluorosurfactants.

* * * * *